US007946362B2

(12) United States Patent
Da Silva et al.

(10) Patent No.: US 7,946,362 B2
(45) Date of Patent: May 24, 2011

(54) MATRIX DRILL BITS WITH BACK RAKED CUTTING ELEMENTS

(75) Inventors: Nuno Da Silva, Brussels (BE); Valérie Sillen, Forest (BE); Nicolas Luyckx, Mons (BE)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/687,472

(22) Filed: Mar. 16, 2007

(65) Prior Publication Data

US 2007/0215389 A1 Sep. 20, 2007

Related U.S. Application Data

(63) Continuation of application No. PCT/EP2006/060834, filed on Mar. 17, 2006.

(51) Int. Cl.
*E21B 10/54* (2006.01)

(52) U.S. Cl. ..... 175/434; 175/431

(58) Field of Classification Search ..... 175/426, 175/430, 431, 432, 434
See application file for complete search history.

(56) References Cited

U.S. PATENT DOCUMENTS

| | | | | |
|---|---|---|---|---|
| 1,961,390 | A | 6/1934 | Ragsdale | 255/61 |
| 2,290,595 | A | 7/1942 | Kinnear | 175/379 |
| 2,976,927 | A | 3/1961 | Kammerer, Jr. et al. | 166/55.8 |
| 3,095,053 | A | 6/1963 | Pistole et al. | 175/327 |
| 3,106,973 | A | 10/1963 | Christensen | 175/413 |
| 3,163,246 | A | 12/1964 | Vagins et al. | 175/410 |
| 3,599,736 | A | 8/1971 | Thompson | 175/434 |
| 3,709,308 | A * | 1/1973 | Rowley et al. | 175/434 |
| 3,747,699 | A * | 7/1973 | Feenstra et al. | 175/434 |
| 4,274,769 | A | 6/1981 | Multakh | 408/145 |
| 4,602,691 | A * | 7/1986 | Weaver | 175/430 |
| 4,681,174 | A | 7/1987 | Aubakirov et al. | 175/330 |
| 4,718,505 | A | 1/1988 | Fuller | 175/329 |
| 4,726,718 | A | 2/1988 | Meskin et al. | 408/145 |
| 4,823,892 | A | 4/1989 | Fuller | 175/329 |
| 4,883,132 | A | 11/1989 | Tibbitts | 175/65 |
| 4,889,017 | A | 12/1989 | Fuller et al. | 76/108 |

(Continued)

FOREIGN PATENT DOCUMENTS

DE 296 11 966 U1 11/1997

(Continued)

OTHER PUBLICATIONS

International Search Report and Written Opinion; PCT/EP2006/060834; p. 14, Sep. 26, 2007.

(Continued)

*Primary Examiner* — Hoang Dang
(74) *Attorney, Agent, or Firm* — Baker Botts L.L.P.

(57) ABSTRACT

A matrix drill bit and method of manufacturing a matrix bit having back raked cutting elements is disclosed. In one aspect, a matrix drill bit for well drilling includes a matrix bit body that has a front area in a direction of drilling and two or more diamond impregnated cutting blades protruding from the front area of the matrix bit body. The cutting blades each have a front external surface protruding from the front area of the matrix bit body and present a plurality of back raked downhole interface surfaces in the direction of drilling. The downhole interface surfaces span a leading face and a trailing face where the leading face extends to a first height and the trailing face extends to a second height and the first height is greater than the second height.

25 Claims, 2 Drawing Sheets

U.S. PATENT DOCUMENTS

| | | | | |
|---|---|---|---|---|
| 4,991,670 | A | 2/1991 | Fuller et al. | 175/329 |
| 5,000,273 | A | 3/1991 | Horton et al. | 175/329 |
| 5,028,177 | A | 7/1991 | Meskin et al. | 408/145 |
| 5,158,393 | A | 10/1992 | Bossler | 404/9 |
| 5,205,684 | A | 4/1993 | Meskin et al. | 408/145 |
| 5,252,009 | A | 10/1993 | Bossler | 408/145 |
| 5,282,513 | A * | 2/1994 | Jones | 175/434 |
| 5,848,348 | A | 12/1998 | Dennis | 419/5 |
| 5,937,958 | A * | 8/1999 | Mensa-Wilmot et al. | 175/398 |
| 5,967,246 | A | 10/1999 | Caraway et al. | 175/393 |
| 6,009,962 | A | 1/2000 | Beaton | 175/426 |
| 6,016,878 | A | 1/2000 | Jansson | 175/27 |
| 6,095,265 | A | 8/2000 | Alsup | 175/379 |
| 6,241,036 | B1 | 6/2001 | Lovato et al. | 175/432 |
| 6,248,447 | B1 * | 6/2001 | Griffin et al. | 428/408 |
| 6,454,030 | B1 | 9/2002 | Findley et al. | 175/425 |
| 6,458,471 | B2 | 10/2002 | Lovato et al. | 428/553 |
| 6,474,425 | B1 | 11/2002 | Truax et al. | 175/398 |
| 6,510,906 | B1 | 1/2003 | Richert et al. | 175/39 |
| 6,695,073 | B2 | 2/2004 | Glass et al. | 175/40 |
| 6,742,611 | B1 | 6/2004 | Illerhaus et al. | 175/433 |
| 6,823,952 | B1 | 11/2004 | Mensa-Wilmot et al. | 175/432 |
| 6,843,333 | B2 | 1/2005 | Richert et al. | 175/379 |
| 2001/0047891 | A1 * | 12/2001 | Truax et al. | 175/426 |
| 2004/0154840 | A1 | 8/2004 | Azar et al. | 175/434 |
| 2004/0244540 | A1 | 12/2004 | Oldham et al. | 76/108.2 |

FOREIGN PATENT DOCUMENTS

| | | | |
|---|---|---|---|
| DE | 197 12 181 | A1 | 1/1998 |
| EP | 0360111 | A1 | 9/1989 |
| EP | 1081119 | | 3/2001 |
| EP | 1288432 | | 3/2003 |
| GB | 2268768 | A | 7/1993 |
| GB | 2356655 | | 11/2000 |
| GB | 2393449 | | 9/2003 |
| GB | 2398316 | | 8/2004 |

OTHER PUBLICATIONS

U.S. Appl. No. 60/644,369, filed Dec. 22, 2004, Lapointe.

International Search Report for Application No. PCT/BE2005/000028 (3 pages), Oct. 13, 2005.

Da Silva et al., "Drill Bit with a Fixed Cutting Structure," U.S. Appl. No. 11/816,808, pending, filed Aug. 30, 2007.

Da Silva et al., Preliminary Amendment for "Drill Bit with a Fixed Cutting Structure," U.S. Appl. No. 11/816,808, pending, filed Aug. 30, 2007.

U.S. Patent and Trademark Office, Office Action for U.S. Appl. No. 11/816,808, filed Aug. 30, 2007, Numo Da Silva et al., Electronically Mailed May 30, 2008.

European Patent Office Invitation Pursuant to 94(3) and Rule 71(1) EPC; Application No. 06 725 132.2-2315; Ref. 130 692 a/jme, Jun. 30, 2009.

International Office Action, Application No. EP 06725132.2, 3 pages, Nov. 20, 2009.

* cited by examiner

MATRIX DRILL BITS WITH BACK RAKED CUTTING ELEMENTS

RELATED APPLICATION

This application is a continuation of International Patent Application No. PCT/EP2006/060834, filed on Mar. 17, 2006.

TECHNICAL FIELD

The present invention is related to rotary drill bits and more particularly to matrix drill bits having diamond impregnated back raked cutting structures.

BACKGROUND OF THE INVENTION

Rotary drill bits are frequently used to drill oil and gas wells, geothermal wells and water wells. Rotary drill bits may be generally classified as rotary cone or roller cone drill bits and fixed cutter drilling equipment or drag bits. Fixed cutter drill bits or drag bits are often formed with a matrix bit body having cutting elements or inserts disposed at select locations of exterior portions of the matrix bit body. Fluid flow passageways are typically formed in the matrix bit body to allow communication of drilling fluids from associated surface drilling equipment through a drill string or drill pipe attached to the matrix bit body. Such fixed cutter drill bits or drag bits may be referred to as "matrix drill bits."

Matrix drill bits are typically formed by placing loose matrix material (sometimes referred to as "matrix powder") into a mold and infiltrating the matrix material with a binder such as a copper alloy. The mold may be formed by milling a block of material such as graphite to define a mold cavity with features that correspond generally with desired exterior features of the resulting matrix drill bit. Various features of the resulting matrix drill bit such as blades, cutter pockets, and/or fluid flow passageways may be provided by shaping the mold cavity and/or by positioning temporary displacement material within interior portions of the mold cavity. A preformed steel shank or bit blank may be placed within the mold cavity to provide reinforcement for the matrix bit body and to allow attachment of the resulting matrix drill bit with a drill string.

Matrix bits, and in particular diamond impregnated matrix bits, are typically used for drilling hard rock formations such as granite using a grinding-type action. However, matrix bits often experience problems when drilling in formations that include hard rock formations interspersed with layers or inclusions of soft rock such as soft shale or limestone. As matrix bits drill through such portions of soft rock the resulting cuttings often have a relatively sticky consistency and are not thoroughly removed by the interaction between the matrix bit and drilling fluid. Additionally, the grinding action of the matrix bit is often ineffective in relatively soft formations. As a result, after a matrix bit passes through a layer of soft formation and returns to drilling hard rock, material may remain in the indentations, grooves and cavities of the drill bit, often interfering with the grinding-type action of the drill bit in the hard rock formation. This material often significantly decreases the overall effectiveness of the drill bit and significantly limits the application of matrix bits.

SUMMARY OF THE DISCLOSURE

In accordance with teachings of the present disclosure, a diamond impregnated matrix bit having back raked cutting elements is provided to reduce problems encountered in drilling operations using previous diamond impregnated matrix bits.

In one aspect, a matrix drill bit for well drilling includes a matrix bit body that has a front area in a direction of drilling and two or more diamond impregnated cutting blades protruding from the front area of the matrix bit body. The cutting blades each present a plurality of back raked downhole interface surfaces in the direction of drilling. The downhole interface surfaces span a leading face and a trailing face where the leading face extends to a first height and the trailing face extends to a second height and the first height is greater than the second height.

In another aspect, a drill bit having a matrix bit body is disclosed that includes multiple diamond impregnated cutting elements disposed at selected locations on exterior portions of the matrix bit body. The cutting elements present a back raked downhole interface surface in the direction of drilling. The downhole interface surface spans between a leading face and a trailing face where the leading face extends to a first height and the trailing face extends to a second height. The first height is greater than the second height.

In yet another aspect, a method of making a matrix drill bit is disclosed that includes forming a plurality of impregnated diamond cutting blades that each present multiple back raked downhole interface surfaces spanning between a leading face and a trailing face. The leading face extends to a first height and the trailing face extending to a second height where the first height is greater than the second height. The method also includes selectively positioning the cutting elements at selected locations on exterior portions of the matrix bit body and presenting the downhole interface surfaces of the cutting elements in the direction of drilling.

Technical benefits of the disclosure include, but are not limited to, eliminating or substantially reducing existing problems associated with drilling in hard rock formations containing layers or inclusions of soft rock. For example, the use of back raked cutting elements allows the diamond impregnated matrix bit to drill through a relatively soft formation via a shearing action and drill through a relatively hard formation using a grinding-type action. Additional advantages are detailed in the Figures, description and claims below.

BRIEF DESCRIPTION OF THE DRAWINGS

A more complete and thorough understanding of the present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1:
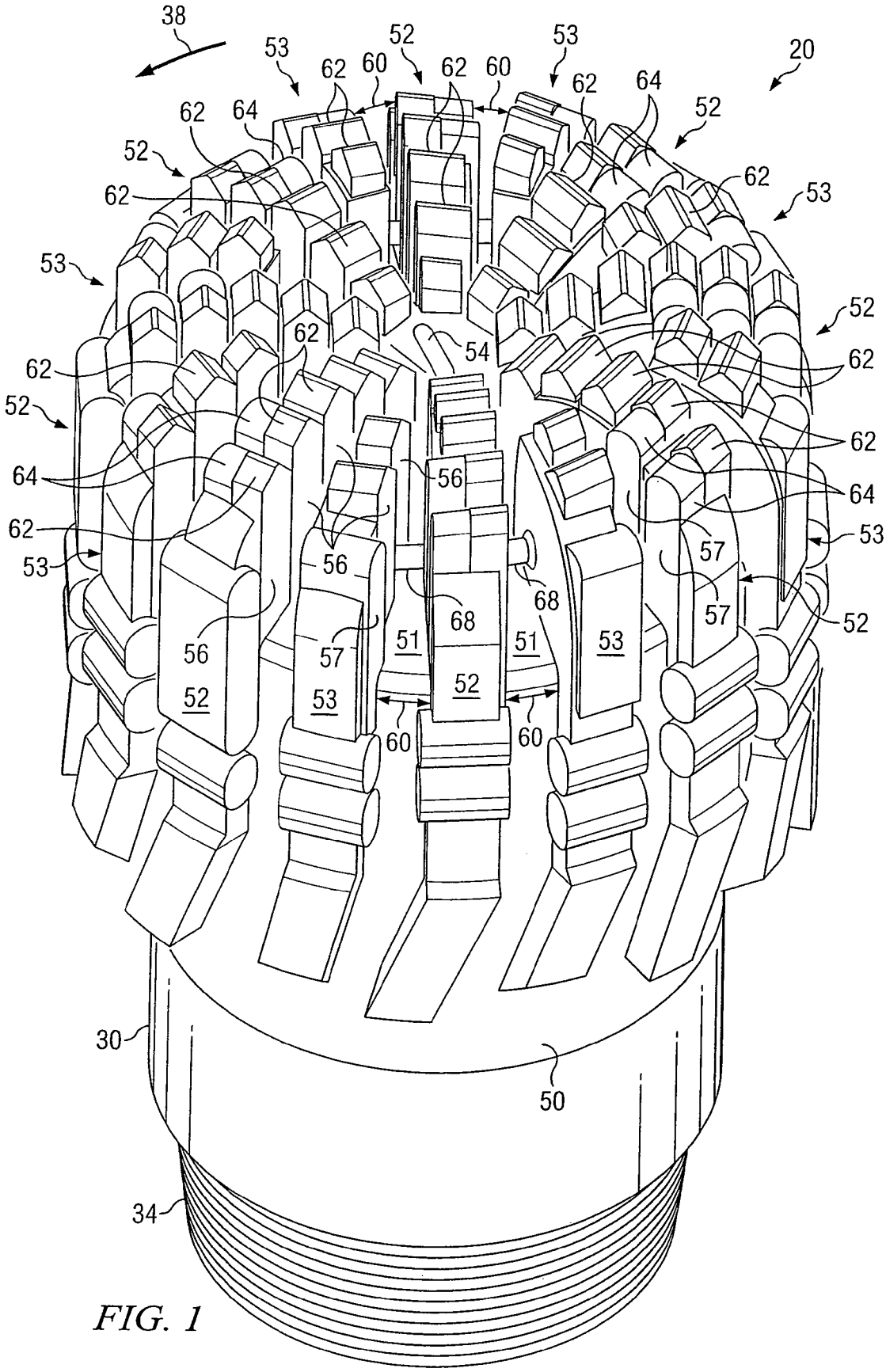
FIG. 1 is a schematic drawing showing an isometric view of a matrix drill bit formed in accordance with teachings of the present disclosure.

Preferred embodiments of the disclosure and its advantages are best understood by reference to FIGS. 1-4 wherein like numbers refer to like and corresponding parts.

The terms "matrix drill bit" and "matrix bit" may be used in this application to refer to any fixed cutter bit formed using matrix material incorporating teachings of the present disclosure. Such drill bits may be used to form well bores or boreholes in subterranean formations. Matrix drill bits incorporating teachings of the present disclosure may include a matrix bit body formed from loose matrix material and combined with a binder alloy in a suitable mold form.

For some applications the matrix material may include microcrystalline tungsten carbide, cast carbides, cemented carbides, spherical carbides, any other suitable matrix material or a combination thereof. A binder material may be used to infiltrate the matrix material to form a coherent, composite matrix bit body. Binder materials may include, but are not limited to, copper and copper based alloys formed at least in part with one or more of the following elements—manganese (Mn), nickel (Ni), tin (Sn), zinc (Zn), silicon (Si), molybdenum (Mo), tungsten (W) and phosphorous (P). The composite matrix bit body may be attached to a metal shank. A tool joint having a threaded connection operable to releasably engage the associated matrix drill bit with a drill string, drill pipe, bottom hole assembly or downhole drilling motor may be attached to the metal shank.

The terms "cemented carbide" and "cemented carbides" may be used within this application to include WC, MoC, TiC, TaC, NbC, and solid solutions mixed carbides such as WC—TiC, WC—TiC—TaC, WC—TiC—(Ta,Nb)C in a metallic binder (matrix) phase, typically Co, Ni, Fe, Mo or their alloys in powder form. Cemented carbides may also be referred to as sintered carbides or spherical carbides. Cemented carbides may be generally described as powdered refractory carbides which have been united by compression and heat with bonding materials such as cobalt, iron, nickel or their alloys and then sintered, crushed, screened and further processed. The bonding material provides ductility and toughness which often results in greater resistance to fracture (toughness) of cemented carbides as compared to macrocrystalline tungsten carbide or formulates thereof. Cemented carbides may sometimes be referred to as "composites."

Various metals such as cobalt, nickel, iron etc. or their alloys may be used as bonding material to form cemented carbides.

Spherical carbides may be described as cast carbides having two phases of both tungsten monocarbide and ditungsten carbide.

Macrocrystalline tungsten carbide may be generally described as relatively small particles (powders) of single crystals of monotungsten carbide with additions of cast carbide, Ni, Fe, Carbonyl of Fe, Ni, etc. Both cemented carbides and macrocrystalline tungsten carbides are generally described as hard materials with high resistance to abrasion, erosion and wear.

The terms "binder" or "binder material" may be used in this application to include copper, cobalt, nickel, iron or any alloys of these materials satisfactory for use in forming a matrix drill bit.

FIG. 1 is a schematic drawing showing one example of a matrix drill bit indicated generally at 20, formed with a matrix bit body in accordance with teachings of the present disclosure. For embodiments such as shown in FIG. 1, matrix drill bit 20 may include threaded metal shank 30 with matrix bit body 50 securely attached thereto. In one embodiment matrix bit body 50 may be formed from a composite of tungsten carbide and diamond impregnated segments. Metal shank 30 may be described as having a generally hollow, cylindrical configuration defined in part by a fluid flow passageway (not expressly shown) extending therethrough. Tool joints with various types of threaded connections, such as American Petroleum Institute (API) threaded pin 34, may be attached to metal shank 30 opposite from matrix bit body 50.

For some applications metal shank 30 may be formed from two or more components such as a hollow, generally cylindrical metal blank and a hollow, generally cylindrical tool joint as is well known in the art. Such metal blank and tool joint may be formed from various steel alloys or any other metal alloy associated with manufacturing rotary drill bits.

Figure 2:
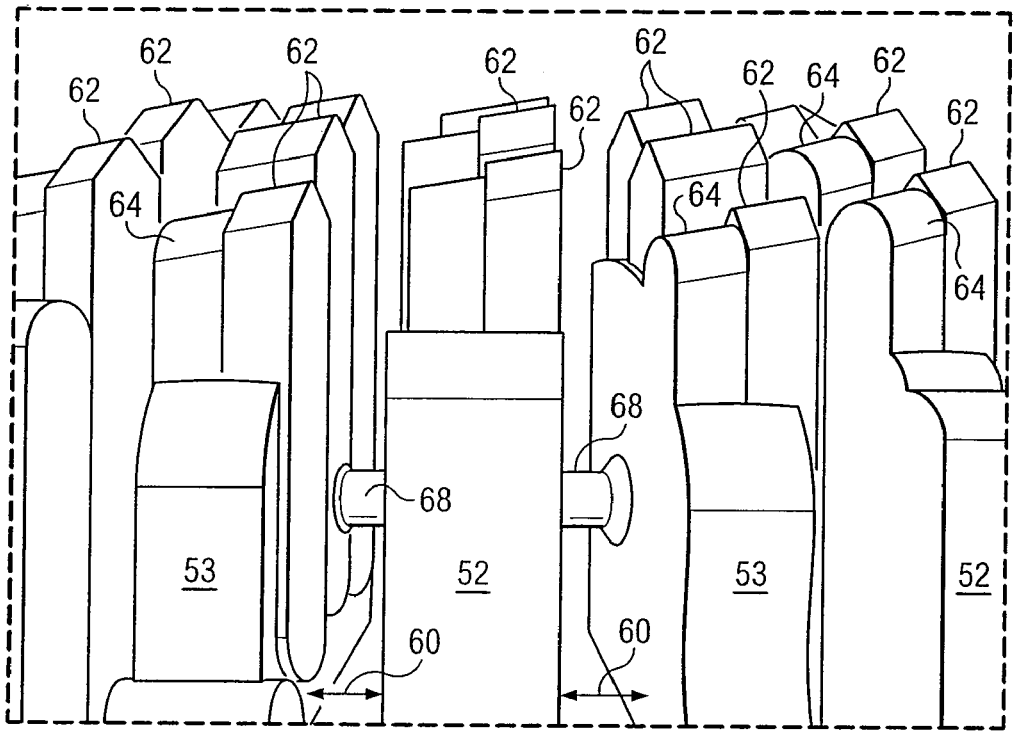
FIG. 2 is a schematic drawing in section with portions broken away showing cutting elements of a matrix drill bit formed in accordance with teachings of the present disclosure.

As shown, matrix drill bit is formed to rotate in the direction of arrow 38 and may include a plurality of cutting blades, cutting structures, junk slots, and/or fluid flow paths may be formed on or attached to exterior portions of an associated bit body. For embodiments such as shown in FIGS. 1 and 2, a plurality of diamond impregnated cutting blades 52 and 53 (which may be referred to as "blades" or "cutting blades" herein) may be formed to protrude from the front area 51 of the exterior of matrix bit body 50. Cutting blades 52 and 53 including primary cutting blades 52 and secondary cutting blades 53. In the embodiment shown in FIG. 1, primary blades 52 generally extend from the approximate center of bit body 50 and extend to the outer or gage diameter. Additionally, secondary blades 53 extend from a selected radius to the outer diameter of matrix bit body 50. In alternate embodiments bit 20 may include more or fewer blades or blade configurations.

In some embodiments, blades 52 and 53 may comprise one or more diamond impregnated sintered cutting blades. In some embodiments, blades 52 and 53 may comprise one or more diamond impregnated infiltrated cutting blades. In alternate embodiments, all blades 52 and 53 may be constructed of diamond impregnated sintered cutting blades or diamond impregnated infiltrated cutting blades.

Cutting blades 52 and 53 present multiple downhole interface surfaces 62 and 64. As shown, downhole interfaces 62 are configured to present a generally peaked configuration in the direction of drilling. Downhole interfaces 64 are configured to present a generally rounded configuration in the direction of drilling. Each blade 52 and 53 may present one or more of either type of downhole interface surface and may also present downhole interface surfaces in series such that a rounded interface surface 64 trails a peaked interface surface 62 or vice versa.

In the embodiments shown in FIGS. 1 and 2, each blade is formed from multiple individual cutting elements 56 and 57. In a particular embodiment, one or more of cutting elements 56 and 57 comprise thermally stable polycrystalline cutting elements. Such cutting elements may be formed separately and selectively positioned within a mold prior to filling the mold with matrix powder and infiltrating the matrix material with a binder.

Figure 3A:
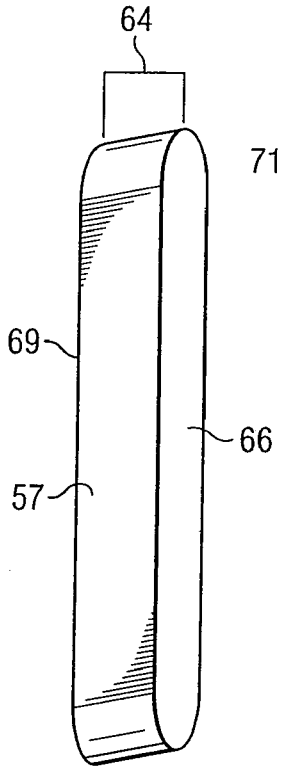
FIGS. 3A and 3B are schematic drawings of a cutting element having a rounded cutting surface formed in accordance with teachings of the present disclosure.
Figure 3B:
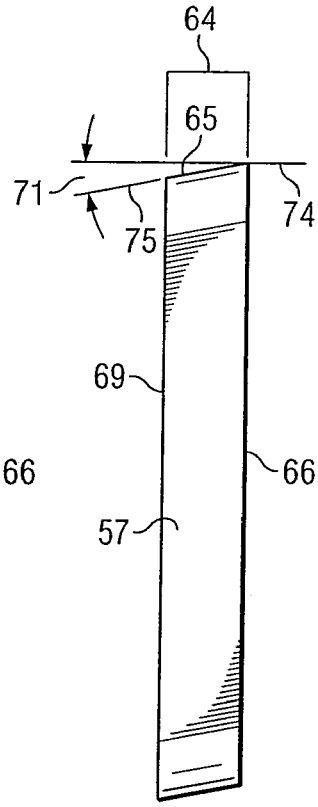
Figure 4A:
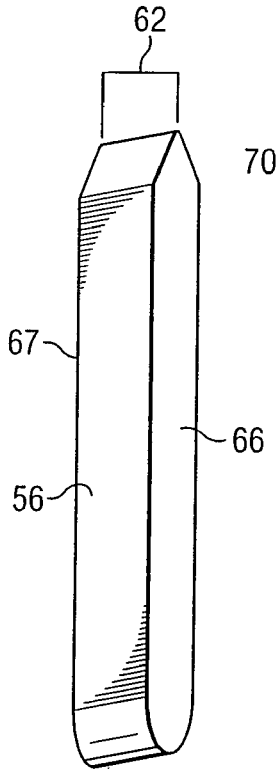
FIGS. 4A and 4B are schematic drawings of a cutting element having a peaked cutting surface formed in accordance with teachings of the present disclosure.
Figure 4B:
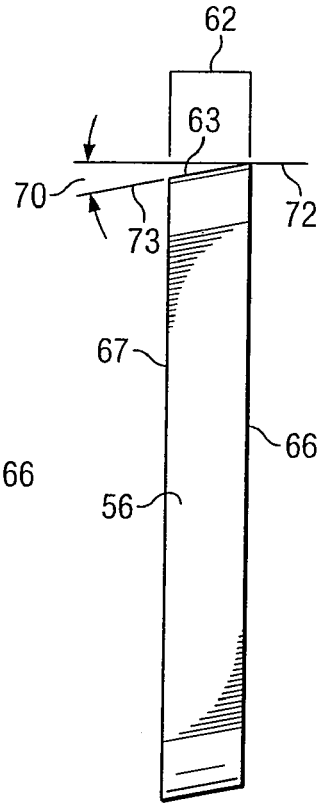

In the present embodiments, cutting blades 52 and 53 present multiple downhole interface surfaces 62 and 64. As shown in FIG. 3B, downhole interface surface 64 is back raked according to back rake angle 65 and, as shown in FIG. 4B, downhole interface surface 62 is back raked according to back rake angle 63. The back raked configuration of downhole interface surfaces 62 and 64 is preferably configured to allow the interface surfaces to shear relatively soft formation materials and to grind through relatively hard formation materials.

In some embodiments, back rake angles 63 and 65 may be between approximately ten (10) degrees and approximately thirty (30) degrees. In the present embodiments downhole interface surfaces 62 and 64 present a generally linear sloped surface. Downhole interface surface 62 span between a leading face 66 and a trailing face 67. Leading face 66 extends to a first height 72 and trailing face 67 extends to a second height 73. First height 72 is greater than second height 73. In some embodiments the difference in height 70 between leading face 72 and trailing face 67 is between approximately five millimeters and approximately twenty millimeters.

Similarly, rounded downhole interface surface 64 spans between a leading face 66 and a trailing face 69. Leading face 68 extends to a first height 74 and trailing face 69 extends to a second height 75. First height 74 is greater than second height 75. In some embodiments the difference in height 71 between leading face 74 and trailing face 75 is between approximately five millimeters and approximately twenty millimeters.

In the present embodiments blades 52 and 53 are spaced from each other on front area 51 of composite matrix bit body 50 to form fluid flow paths 60 (which may also be referred to as slots or junk slots) therebetween. In some embodiments fluid flow paths may have a width between five millimeters and thirty millimeters. In the present embodiments, a bridge element 68 spans between blades 52 and 53. Each bridge element 68 is coupled to the alternating faces of blades 52 and 53 and is configured to provide additional structural support thereto. Alternate embodiments may present more than one bridge element between blades 52 and 53 or may not include any bridge elements or other additional structural support. In the present embodiments, bridge element 68 has a generally cylindrical configuration, however, in alternate embodiments bridge element 68 may have any configuration suitable for providing structural support to blades 52 and 53 while allowing cuttings and drilling fluid to flow through slot 60.

One or more fluid openings 54 may be formed in composite bit body 50. Various types of drilling fluid may be pumped from surface drilling equipment (not expressly shown) through a drill string (not expressly shown) attached with threaded connection 34 and fluid flow passageways to exit from the one or more fluid openings 54. The cuttings, downhole debris, formation fluids and/or drilling fluid may return to the well surface through an annulus (not expressly shown) formed between exterior portions of the drill string and interior of an associated well bore (not expressly shown).

Although the present disclosure and its advantages have been described in detail, it should be understood that various changes, substitutions and alternations can be made herein without departing from the spirit and scope of the disclosure as defined by the following claims.

What is claimed is:

1. A matrix drill bit for well drilling comprising:

a matrix bit body having a front area in a direction of drilling;

two or more diamond impregnated cutting blades protruding from the front area of the matrix bit body, wherein the two or more diamond impregnated cutting blades are formed unitarily as part of the matrix bit body, resulting in a coherent, composite matrix bit body; and each cutting blade presenting a plurality of back raked diamond impregnated downhole interface surfaces in the direction of drilling, each back raked diamond impregnated downhole interface surface spanning a leading face and a trailing face, the leading face extending to a first height and the trailing face extending to a second height, the first height greater than the second height.

2. The matrix drill bit according to claim 1 wherein the two or more cutting blades comprise diamond impregnated sintered cutting blades.

3. The matrix drill bit according to claim 1 wherein the two or more cutting blades comprise diamond impregnated infiltrated cutting blades.

4. The matrix drill bit according to claim 1 comprising a plurality of the back raked downhole interface surfaces having a peaked configuration.

5. The matrix drill bit according to claim 1 comprising a plurality of the back raked downhole interface surfaces having a rounded configuration.

6. The matrix drill bit according to claim 1 comprising:

a plurality of back raked downhole interface surfaces each having a peaked configuration; and a plurality of back raked downhole interface surfaces each cutting elements having a rounded configuration.

7. The matrix drill bit according to claim 6 comprising at least one of the cutting blades having a rounded downhole interface surface disposed adjacent and trailing a cutting element having a peaked downhole interface surface.

8. The matrix drill bit according to claim 1 comprising the plurality of back raked cutting blade interface surfaces each having a back rake angle between approximately ten degrees and approximately thirty degrees.

9. The matrix drill bit according to claim 1 comprising the difference in height between the leading face and the trailing face between approximately five millimeters and approximately twenty millimeters.

10. The matrix drill bit according to claim 1 comprising;

at least one primary cutting blade protruding from the front area of the matrix bit body and extending radially from an approximate center of the front area of matrix bit body to an approximate gauge diameter of the matrix bit body; and at least one secondary blade protruding from the front area of the matrix bit body and extending radially from a selected radius of the matrix bit body to the approximate gauge diameter of the matrix bit body.

11. The matrix drill bit according to claim 1 further comprising a slot formed between each of the cutting blades configured to allow cutting materials to flow therethrough.

12. The matrix drill bit according to claim 11 comprising the slot having a width between five millimeters and thirty millimeters.

13. The matrix drill bit according to claim 11 further comprising at least one bridge element coupled to two of the cutting blades and spanning the slot therebetween.

14. The matrix drill bit according to claim 1 comprising the matrix bit body formed from a composite of tungsten carbide and diamond impregnated segments.

15. The matrix drill bit according to claim 1 comprising the back raked downhole interface surfaces configured to shear soft formation and to grind a hard formation.

16. The matrix drill bit according to claim 1 wherein the cutting blades each comprise one or more thermally stable polycrystalline cutting elements formed therein.

17. A drill bit having a matrix bit body comprising:

a plurality of diamond impregnated cutting elements disposed at selected locations on exterior portions of the matrix bit body, wherein the plurality of diamond impregnated cutting elements are formed unitarily as part of the matrix bit body, resulting in a coherent, composite matrix bit body; and each cutting element presenting a back raked diamond impregnated downhole interface surface in the direction of drilling, the diamond impregnated downhole interface surface spanning a leading face and a trailing face, the leading face extending to a first height and the trailing face extending to a second height, the first height greater than the second height.

18. The matrix drill bit according to claim 17 wherein the plurality of cutting elements comprise diamond impregnated sintered cutting elements.

19. The matrix drill bit according to claim 17 wherein the plurality of cutting elements comprise diamond impregnated infiltrated cutting elements.

20. The matrix drill bit according to claim 17 comprising the back raked downhole interface surface configured to shear a soft formation and to grind a hard formation.

21. The matrix drill bit according to claim 17 comprising a plurality of the back raked cutting element interface surfaces having a peaked configuration.

22. The matrix drill bit according to claim 17 comprising a plurality of the back raked cutting element interface surfaces having a rounded configuration.

23. The matrix drill bit according to claim 17 comprising the back raked cutting element interface surface having a back rake angle between approximately ten degrees and approximately thirty degrees.

24. The matrix drill bit according to claim 17 comprising the difference in height between the leading face and the trailing face between approximately five millimeters and approximately twenty millimeters.

25. A method of making a matrix drill bit comprising:

forming a plurality of impregnated diamond cutting blades unitarily as part of a matrix bit body, resulting in a coherent, composite matrix bit body, each cutting blade presenting a back raked diamond impregnated downhole interface surface spanning a leading face and a trailing face, the leading face extending to a first height and the trailing face extending to a second height, the first height greater than the second height; and wherein each of the plurality of cutting blades are formed at selected locations on exterior portions of the matrix bit body presenting the diamond impregnated downhole interface surfaces of the cutting blades in the direction of drilling.

* * * * *